US005368517A

United States Patent [19]

Pagani

[11] Patent Number: 5,368,517

[45] Date of Patent: Nov. 29, 1994

[54] SPEAKING TOYS

[75] Inventor: David A. Pagani, Montpelier, Vt.

[73] Assignee: New Ventures, Inc., Montpelier, Vt.

[21] Appl. No.: 65,630

[22] Filed: May 21, 1993

[30] Foreign Application Priority Data

Nov. 19, 1992 [GB] United Kingdom ..... 9224297.3

[51] Int. Cl.[5] ..... A63H 3/28; A63H 5/00

[52] U.S. Cl. ..... 446/297; 446/397

[58] Field of Search ..... 446/297, 303, 298, 300, 446/301, 397; 340/384 E

[56] References Cited

U.S. PATENT DOCUMENTS 4,249,338 2/1981 Wexler ..... 446/297 X 4,973,941 11/1990 Davis et al. ..... 446/297 X 5,092,810 3/1992 Kwan et al. ..... 446/397 X 5,137,488 8/1992 Yeh ..... 446/397

*Primary Examiner*—Mickey Yu

*Attorney, Agent, or Firm*—Thompson, Hine & Flory

[57] ABSTRACT

A speaking unit for a toy squirrel formed with a flexible plastic body 10 consists of two halves 12 and 13 containing electrical components. The unit has a loudspeaker 26 adjacent one end where an annular groove 24 is provided which fits against sides of an aperture 11. An electrical switch button 22 is held against an inside surface of the body 10 so that when the squirrel is squeezed a voice chip 20 is initiated to broadcast a message.

5 Claims, 1 Drawing Sheet

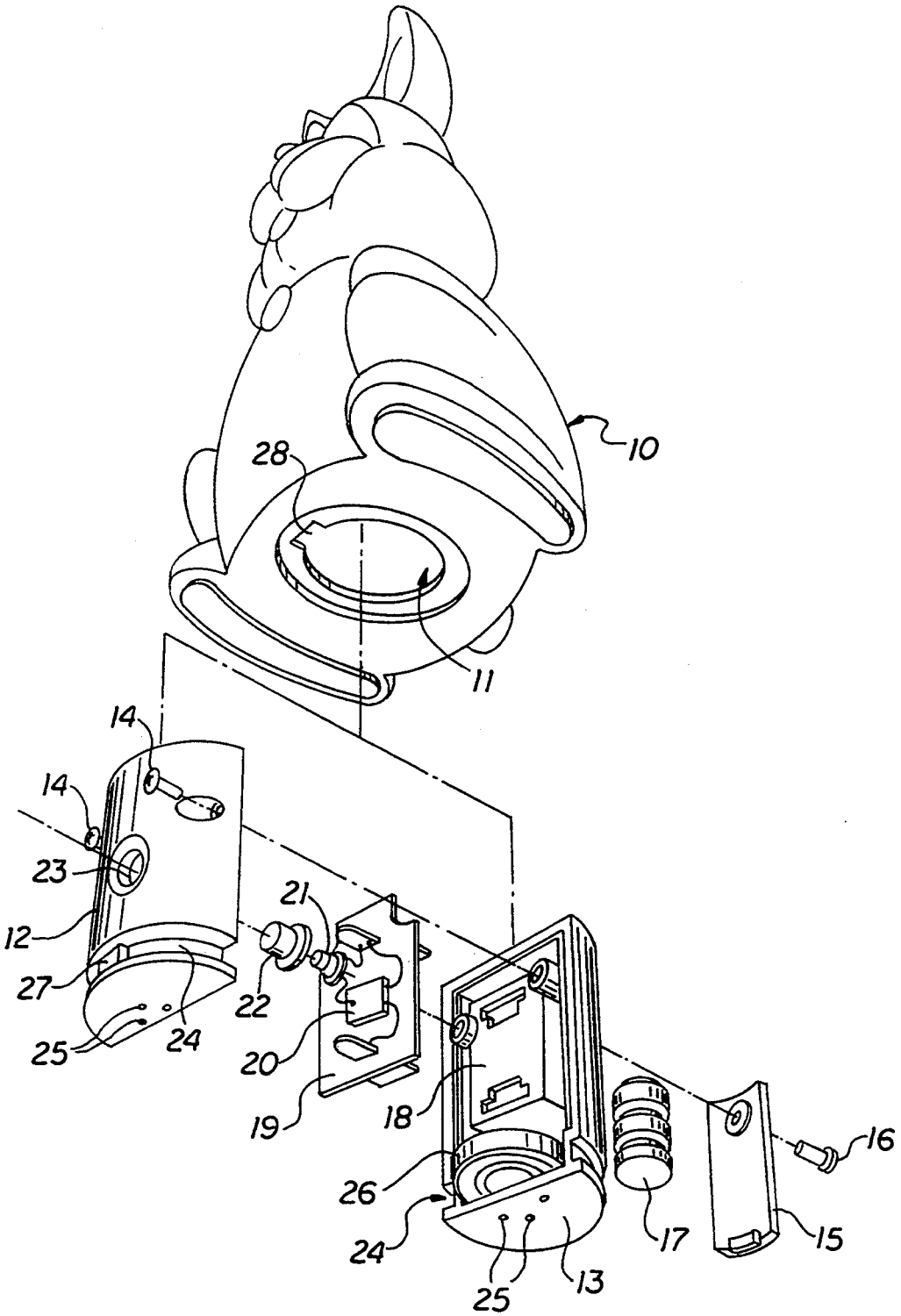
10
28
11
14
14
23
12
27
25
24
21
22
20
19
18
26
24
25
13
17
15
16

SPEAKING TOYS

BACKGROUND OF THE INVENTION

It is already known to provide speaking units which incorporate a voice record semi-conductor chip for generating a single or multiple message to be broadcast when the toy is used or played with. Such chips are driven by small batteries and activated as required or desired in the course of play.

It is an object of the invention to provide speaking units for use with generally small molded plastic toy animals and the like.

SUMMARY OF THE INVENTION

According to the invention there is provided a speaking unit for a hollow molded flexible plastic toy animal or the like, the unit comprising a rigid housing having a base at one end with apertures formed therein, and electrical components including a loudspeaker mounted inside the housing adjacent the one end, a voice message chip mounted in the housing and a circuit with a switch operable from outside the housing for initiating broadcasting of the message, in which the housing is arranged to be insertable through an aperture in the animal and held in position by the sides of the aperture with the base generally flush with the outer surface of the animal surrounding the aperture.

The switch may be provided with an operating button which extends through a side of the housing and initiates the broadcasting whenever the extension of the button is depressed towards the housing.

The housing may be formed by two halves arranged to be held together and between which is mounted all the electrical components of the unit.

The unit is preferably cylindrical and formed with a peripheral annular groove adjacent its one end to receive and be held by the sides of the aperture. A locating protrusion or slot may be provided in the annular groove and arranged to cooperate with a slot or protrusion respectively in the aperture to prevent the unit rotating with respect to the aperture.

A flexible toy animal having a speaking unit according to the invention will now be described by way of example with reference to the accompanying drawing, the detailed description and the appended claims.

BRIEF DESCRIPTION OF THE DRAWINGS

The drawing shows an isometric view of a toy squirrel and an isometric exploded view of the speaking unit in accordance with the present invention.

DETAILED DESCRIPTION

Referring to the drawing, the animal is formed as a rotocast flexible latex plastics hollow body 10 with a circular aperture 11 in its base. The speaking unit is formed by two semi-cylindrical halves 12 and 13 of rigid plastics material and held together by screws 14. One of the half 13 has an opening (not visible in the drawing) which is closed by a lid 15 held to the half 13 by a screw 16. A battery 17 fits inside the unit behind the lid 15 and against an underside of a central platform 18.

The platform 18 supports a module 19 of electrical components including a voice recording integrated circuit chip 20 and a switch 21. A switch operating button 22 slidingly fits in a hole 23 in the half 12 and extends beyond the outer surface of the half 12.

An annular groove 24 extends all the way around the speaking unit adjacent one end in which end apertures 25 are provided and behind which is mounted a loudspeaker 26. A protrusion 27 in the annular groove 24 fits in a slot 28 in the side of the aperture 11 so that when the speaking unit is fitted to the body 10 the speaking unit cannot rotate relative to the body 10. Once positioned in the body the speaking unit is firmly held by the sides of the aperture 11 fitting into the annular groove 24. The button 22 is pressed lightly against an inside surface of the body 10. Whenever the body 10 is squeezed or pressed externally in the region adjacent the button 22, a broadcast is initiated. The broadcast may be a single message, or a series of messages in strict or randon sequence and so on. The provision or election of suitable voice recording chips as such does not in any event form part of the invention. However what will be appreciated is that the base of the housing forms part of and fits flush with the outer surface of the body which surrounds the aperture 11. It will also be appreciated that the speaking unit can be readily and speedily fitted to the body 10 and held in position by the suitably formed sides of the aperture 11. As such the arrangement enables assembly to take the form of a very simple step in a mass production line for example.

The unit may be lightly glued in position in the body 10 but normally it is simply held by the aperture sides fitting into the annular groove 24 as described. The speaking unit can in any event be removed from the body so that the battery 17 can be replaced from time to time as required.

It will be noted that a flexible or soft toy animal is the most likely application for the described speaking unit but the plastics toy may be generally in the form of human being, for example a doll shape, or unanimated object forms, for example a car or a bus. In general however, a safe soft toy is provided which can be roughly used or played with and has no protrusions or sharp edges. The electrical components never-the-less remain securely held in position but the unit is readily assembled in the animal initially and easily removed temporarily to replace the battery 17.

I claim:

1. A toy comprising:

a flexible, hollow toy body having an access aperture;

a speaking unit including a rigid housing positioned within said body, said housing including a base located at one end of said housing and having an annular groove thereon shaped to engage said body and retain said housing fixed therein, sound producing means including a loudspeaker and voice message chip means mounted inside said housing, a switch connected to said sound producing means, protruding from said housing and shaped to abut an interior surface of said toy body, said switch being operable from outside said toy body by deformation thereof to initiate generation of a sound by said sound producing means; and wherein said housing is removably inserted through said aperture in said toy body, and said annular groove engages side portions of said aperture to hold said housing such that said base lies generally flush with an outer surface of said toy surrounding said aperture.

2. A speaking unit according to claim 1 in which the switch is provided with an operating button which extends through a side of the housing and initiates the broadcasting whenever the extension of the button is depressed towards the housing.

3. A speaking unit according to claim 1, in which the housing is formed by two halves arranged to be held together.

4. A speaking unit according to claim 1, in which the unit is cylindrical.

5. A toy comprising:

a flexible, hollow toy body having an access aperture;

a speaking unit including a rigid, cylindrical housing positioned within said body, said housing including a base located at one end of said housing and having an annular groove thereon shaped to engage said body and retain said housing fixed therein, a locating protrusion in said annular groove, said protrusion arranged to cooperate with a slot in said aperture, sound producing means including a loudspeaker and voice message chip means mounted inside said housing, a switch connected to said sound producing means, protruding from said housing and shaped to abut an interior surface of said toy body, said switch being operable from outside said toy body by deformation thereof to initiate generation of a sound by said sound producing means; and wherein said housing is removably inserted through said aperture in said toy body, and said annular groove and protrusion engages side portions of said aperture and said slot to hold said housing such that said base lies generally flush with an outer surface of said toy surrounding said aperture and to prevent said unit from rotating with respect to said aperture.

* * * * *